United States Patent [19]

Resuggan

[11] 4,367,723

[45] Jan. 11, 1983

[54] AIR GUN WITH PISTON FULLY COCKED IN PLURALITY OF STAGES

[75] Inventor: Harold F. Resuggan, Birmingham, England

[73] Assignee: Webley and Scott Limited, Birmingham, England

[21] Appl. No.: 222,676

[22] Filed: Jan. 5, 1981

[30] Foreign Application Priority Data

Jan. 9, 1980 [GB] United Kingdom ..... 8000682

[51] Int. Cl.[3] ..... F41B 11/00

[52] U.S. Cl. ..... 124/67

[58] Field of Search ..... 124/27, 37, 38, 40, 124/66, 67, 68

[56] References Cited

U.S. PATENT DOCUMENTS 2,542,777 2/1951 Loew ..... 124/67

FOREIGN PATENT DOCUMENTS 714832 12/1941 Fed. Rep. of Germany ..... 124/67

3306 of 1908 United Kingdom ..... 124/67

542021 12/1941 United Kingdom ..... 124/38

*Primary Examiner*—Richard T. Stouffer

*Attorney, Agent, or Firm*—LeBlanc, Nolan, Shur & Nies

[57] ABSTRACT

A spring-energized air pistol or other air gun has cocking mechanism, typically lever actuated, e.g. utilizing break action of the gun barrel itself, for urging the air piston to the fully cocked position which operates in at least two stages, two or more strokes of the lever being required for full cocking. Initial strokes of the mechanism move the piston to one or more successive intermediate positions and, in some applications, the gun may be fired from the or an intermediate position enabling it to be selectively used at less than full power.

6 Claims, 1 Drawing Figure

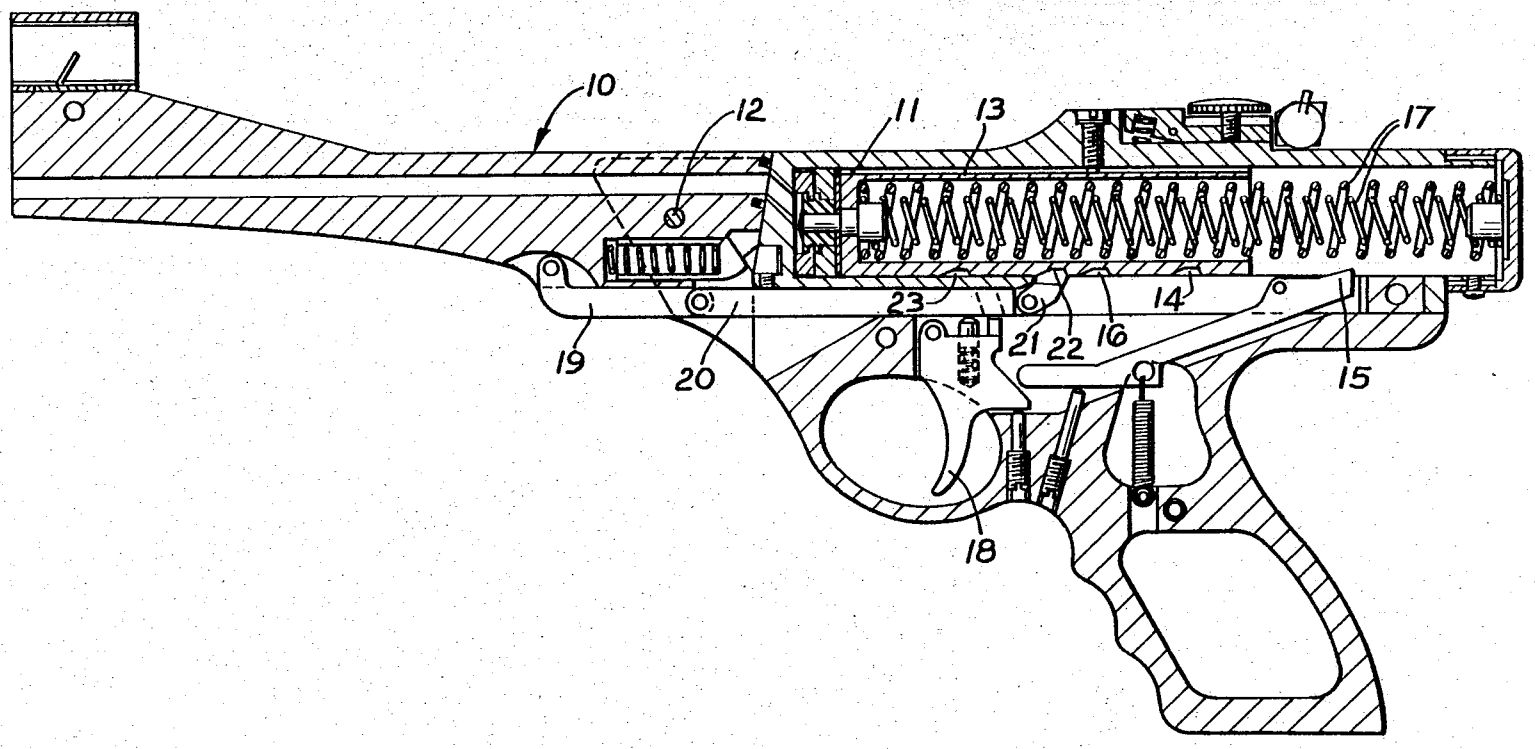
10
11
12
13
14
15
16
17
18
19
20
21
22
23

AIR GUN WITH PISTON FULLY COCKED IN PLURALITY OF STAGES

DESCRIPTION

This invention relates to spring-energised high-velocity air guns (e.g. air rifles or air pistols) of the kind operated by at least one piston which compresses air in a cylinder under the action of at least one main spring so as to eject a projectile from the barrel of the gun, the gun including cocking mechanism enabling the user to move the piston to a fully cocked position at which the main spring or springs are loaded ready for release, and trigger mechanism including retaining means for holding the piston at the fully cocked position until the trigger mechanism is actuated by the user. Guns of this kind are hereinafter referred to as "piston air guns".

The object of the invention is to provide mechanism for a piston air gun which is compact, reliable, and easily operated and which may, optionally be used to provide for operation of the gun at full power and at one or more stages of reduced power. The invention is particularly advantageous when embodied in an air pistol though it may be embodied in other types of piston air gun.

According to the invention there is provided a piston air gun including retaining means arranged to hold the piston at the fully cocked position and at least one intermediate position between the fully cocked position and its fully released position, and cocking mechanism engageable with the piston at the fully released position and at the or each intermediate position to move it towards the fully cocked position whereby the piston is fully cocked in two or more stages by successive repeat movements of the cocking mechanism.

Provision may be made for release of the piston from said intermediate position or positions enabling the gun to be selectively used at less than full power.

One way of carrying out the invention is now described in detail with reference to the accompanying drawing being a longitudinal sectional view of an air pistol embodying the invention .

As with many known types of piston air gun, the barrel 10 serves also as a cocking lever, thus cocking can be effected at the same time as the gun is "broken" and the provision of a separate cocking lever is unnecessary. In this design of pistol the air cylinder 11 is in end-to-end relationship with barrel 10 extending rearwards thereof and, in order to keep the overall length to manageable and pleasing proportions the length of barrel 10 is kept to a minimum, say about 170 mm so that the pistol "breaks" at approximately the halfway point.

In known pistols of this pattern the short barrel reduces the available leverage and makes cocking difficult, so much so that some patterns of pistol are provided with removable barrel extension tubes for cocking purposes.

In the present embodiment the spring loaded piston 13 is provided with a first bent or retaining recess 14 which cooperates with a sear or retaining detent 15 of the trigger mechanism to hold piston 13 at an intermediate position; and a second bent or retaining recess 16 which will cooperate with retaining detent 15 to hold piston 13 at its fully cocked most rearward position at which the main springs 17 are fully loaded in compression. The trigger 18 of the pistol can be operated in conventional manner to move retaining detent 15 out of engagement with either recess 16 or 14 to "fire" the gun from either piston position i.e. at full power, or at half power, with consequent reduction in recoil, a facility which is particularly useful for target shooting.

Cocking of the pistol is effected in two stages (assuming it is to be fully cocked) by means of a pivoted compression link 19 connected to barrel 10 forward of pivot 12 and having a rear end connected to a sliding push piece 20 guided for movement parallel to piston 13. The rear end of push piece 20 carries a pivoted pawl 21 which is sprung to urge it anti-clockwise as viewed in the drawings so that it will project through a groove in the lower wall of cylinder 11.

Piston 13 is provided with first and second pick-up recesses 22, 23 and at respective rearward and forward positions with one or the other of which pawl 21 co-acts immediately as push pieces 20 moves rearward from the position shown in the drawings. The first or rearward recess 12 is engageable by pawl 21 when piston 13 is at the fully released position shown in the drawing. The second or forward pick-up recess 23 is engageable by pawl 21 after returning barrel 10 with push piece 20 to the initial position while the piston is held at its intermediate position by engagement of retaining detent 15 with the first retaining recess 14.

A first full lever movement of barrel 10 will displace piston 13 rearwards from its fully released position to the intermediate position, and a second full movement will urge the piston back from the intermediate position to the fully cocked position for firing at full power.

When barrel 10 is returned to the normal in line "fire" position pawl 21 is retracted clear of piston 13.

This arrangement halves the maximum cocking force which has to be applied to barrel 10 as the mechanical advantage of the lever system is doubled by using the two successive repeat movements of the barrel.

Greater compactness of the lever mechanism is achieved as less travel is required per cocking stroke, thus a much neater appearance is possible in the vicinity of the barrel fulcrum (pivot 12) and the length of various components such as push piece 20 does not have to be so great, nor does the groove in the cylinder wall have to be so long thus giving increased strength.

The intermediate position may be selected to give the required low power mode of operation, for example if the low power is to be half the full power the piston travel in the low power mode may be more than half the total piston travel to compensate for the changing load of the spring (s) 17 during compression due to its rate characteristics.

The two stroke cocking movement may also reduce strain and wear on pivots and other components.

It is conceived that more than one intermediate position may be provided by having additional retaining recesses and pick-up recesses in the piston (it may be that a single recess suitably placed will serve both purposes for certain positions) and the arrangement described may be applied to other forms of piston air guns, for example rifles, guns having side or other cocking levers operated separately from their barrels, and/or dual or other multi-piston air guns.

Having now described my invention, what I claim is:

1. A high performance air gun including an air-compressing power piston mounted in a cylinder, spring means operable to apply a substantial driving force to the piston, a barrel of substantial length pivoted for breaking movement between a loading position at which a projectile is loaded into a breech end of the barrel and an operating position at which the breech is closed for the projectile to be driven along the barrel by air pressure under the action of said piston; trigger releasable retaining means for co-acting automatically with the piston at the fully cocked position and at at least one intermediate position between the fully cocked position and its fully released location to retain the piston at either of said positions; trigger means selectively operable for disengaging the retaining means from the piston when the latter is at either said position so enabling the gun to be used selectively at less than full power, and cocking means driven by lever action of the barrel during said breaking movement and engageable with the piston at the fully released location in an outward lever movement for driving the piston to said intermediate position and re-engageable with the piston following inward lever movement in a repeat outward lever movement for driving the piston from said intermediate position to the fully cocked position, said cocking means including a member longitudinally slidable relative to said cylinder, said member having a pawl mounted thereto for engagement with said piston, said pawl being pivotally mounted to said member and being slidable therewith, said trigger releasable retaining means being located rearwardly of said pawl and being pivotally mounted to said air gun so as to engage said piston rearwardly of where said pawl engages said piston, said cocking means being arranged with high mechanical advantage whereby the piston is fully cocked in a plurality of stages so reducing the effort otherwise needed to effect full cocking against said substantial driving force of said spring means.

2. A gun as in claim 1 wherein said cocking means includes a compression link connected between the barrel and said sliding member for longitudinal movement of the latter in response to said breaking movement of the barrel.

3. A gun as in claim 1 wherein the retaining means is arranged to hold the piston at two positions only, the fully cocked and a single intermediate position.

4. A gun as in claim 3 wherein the position of the intermediate position is selected with respect to rate characteristics of the main spring or springs acting on the piston to give half firing power when released from said intermediate position.

5. A gun as in claim 1 in the form of a pistol.

6. A gun as in claim 5 wherein said pistol has a break action with the air cylinder in end-to end relationship with the barrel rearwardly thereof.

* * * * *